US007833232B2

(12) United States Patent
You

(10) Patent No.: US 7,833,232 B2
(45) Date of Patent: Nov. 16, 2010

(54) EPILATOR

(76) Inventor: Tuming You, 265 Jia He Road, No. 2102, Xiamen (CN)

( * ) Notice: Subject to any disclaimer, the term of this patent is extended or adjusted under 35 U.S.C. 154(b) by 376 days.

(21) Appl. No.: 11/703,044

(22) Filed: Feb. 5, 2007

(65) Prior Publication Data

US 2008/0172070 A1 Jul. 17, 2008

(30) Foreign Application Priority Data

Jan. 12, 2007 (CN) ..... 2007 1 0008441

(51) Int. Cl.
*A61B 17/50* (2006.01)

(52) U.S. Cl. ..... 606/133; 606/131

(58) Field of Classification Search ..... 606/133, 606/131, 43, 30–307; 452/82–86; 30/415, 30/418, 422, 34.05, 32, 346, 31, 304; 83/884; D8/8; D28/10, 44, 50, 82, 88, 33
See application file for complete search history.

(56) References Cited

U.S. PATENT DOCUMENTS 4,651,718 A * 3/1987 Collins et al. ..... 600/142
5,057,115 A * 10/1991 Dolev ..... 606/133
5,462,557 A * 10/1995 Jordan et al. ..... 606/133
6,620,175 B1 * 9/2003 Sueyoshi et al. ..... 606/133
2003/0014059 A1 * 1/2003 Caoduro ..... 606/133
2005/0125008 A1 * 6/2005 Poran ..... 606/133
2008/0001000 A1 1/2008 You
2008/0047172 A1 2/2008 You

OTHER PUBLICATIONS

U.S. Appl. No. 11/651,903, filed Jan. 9, 2007, Tuming You.
U.S. Appl. No. 11/938,731, filed Nov. 12, 2007, Tuming You.

* cited by examiner

*Primary Examiner*—Anhtuan T Nguyen
*Assistant Examiner*—Tin Nguyen
(74) *Attorney, Agent, or Firm*—Squire Sanders & Dempsey, LLP

(57) ABSTRACT

An epilator with an improved structure is provided. The epilator may comprise a main shaft passing through epilating leaves, and a motor device that drives the main shaft. The epilating leaves may comprise a single structure and the two epilating leaves may form a gap therebetween in which hair may be trapped.

15 Claims, 5 Drawing Sheets

EPILATOR

CROSS-REFERENCE TO RELATED APPLICATION

This application claims priority to Chinese patent application No. 200710008441.6, filed on Jan. 12, 2007, the teachings of which are incorporated herein by reference in their entirety.

BACKGROUND OF THE INVENTION

1. Field of the Invention

The present invention relates to an epilator, specifically a kind of hand-holding epilator which is used on human skin.

2. Background of the Invention

The Chinese patent 200420072190.x publishes a kind of electric epilator, mainly includes the body, motor, a reducing gear unit, an arc shaft and a group of epilating leaves. The arc shaft is set on the shaft seats of the body, the initial gear of the reducing gear unit is meshed with the driving gear of the motor. The last gear is fixed on the bottommost single leaf, each single leaf has a clamping face and a supporting part, the entire group of single leaves is arranged with the two clamping faces facing each other, the entire group of single leaves is connected with each other by a fixing element so that all the single leaves will make synchronous rotation, and the entire group of single leaves is inserted through the arc shaft. Since each single leaf has a clamping face and a supporting part, the two clamping faces of the two single leaves face each other, and accordingly the two supporting parts of the two single leaves face each other, too. In its embodiment the shape of each single leaf is looked like a impeller of fan, the two single leaves are superimposed together to form a group, its forks are interleaved each other, meaning that a fork of a single leaf is exactly located between the two forks of nearby single leaf, and that the two clamping faces and the two supporting parts of the two single leaves are oppositely facing each other.

Moreover, for example, the Chinese patent 03823165.4 publishes a kind of epilating efficiency improved epilator, it has hair epilating components, comprising more than two wheels which respectively hold at least a radial extending rotating component located on the wheel by a pin, the side walls of the wheels also comprise clamping plates which protrude radially. The epilator cuts the clamping hair and removing hair through the clamping plates which are respectively located on the wheels.

There are many other similar technology methods, their main structures are similar to above said two methods. The base principle is through the rotation of the arc shaft making the clamping components clamping the epilating leaves so that the epilating leaves clamp the hair of the skin surface and remove it from root. For a long time people thought that only the metal epilating leaves can remove the hair from roots, so the epilating leaves are usually made from metal material. In order to make moulds easily and reduce the cost of manufacturing, the clamping components are made from plastic. This also makes their structures very complex in that it assembles too many components such that when one uses the epilator, these components are easy to come out.

SUMMARY OF THE INVENTION

The present invention is to provide a kind of structure improved epilator, its main objective is to overcome drawbacks of prior art epilators which have very complex structures and too many components that, in operation, are easy to come out.

The present invention adopts the following technology:

An epilator with an improved structure, comprising an epilating leaf set and a motor device which drives the main shaft of the epilating leaf set, the epilating leaf set comprising an arc shaft, on which there are more than two epilating leaves which are synchronously rotating squat-cylinder epilating leaves, each epilating leaf having a single structure that forms an epilating gap between the two epilating leaves.

The said structure improved epilator, the central position of each epilating leaf forms a connecting part, one side of the connecting part is protruding spherical surface, the other side of the connecting part is concave spherical surface. The said main shaft passes through all the centers of the connecting parts, the protruding side of each connecting part of the epilating leaf is moveably engaged with the concave side of the connecting part of the nearby epilating leaf.

Ulteriorly each side of each epilating leaf has the protruding part and the concave part which are respectively engaged with the concave part and the protruding in order to make all the epilating leaves rotate synchronously.

The said structure improved epilator, the said epilating components group is assembled on a base, the base comprising a bottom base, a fixture which is set on the one side of the bottom base, a moveable fixture which is set on the other side of the bottom base. The two ends of the said main shaft are assembled on the fixture and the moveable fixture, all the said epilating leaves are clamped together between the fixture and the moveable fixture, there is also a U shaped spring, its two ends clamp closely all the epilating leaves from outsides of the fixture and the moveable fixture.

Ulteriorly, the two ends of the said main shaft are firmly connected with the fixture and the moveable fixture, and all the said epilating leaves form a epilating leaf set together. On the two sides of the epilating leaf set, there are respectively driving connecting parts, and each connecting part is engaged with the connecting part of nearby epilating leaf by the protruding part and concave part to finish the synchronous rotation, one of the driving connecting parts being firmly connected with the last gear of the motor device gear group.

Between the epilating leaf and the fixture or between the epilating leaf and the moveable fixture, there are respectively thrusting bearings.

On the opposite surface of each epilating leaf there are a concave part and a protruding part which are interleavingly located along the circle of the epilating leaf. Between the two concave parts which are set on the opposite surface of the two nearby epilating leaves forms hair intake groove. Between the two protruding parts which are set on the opposite surface of the two nearby epilating leaves, it forms a hair clamping gap.

The two ends of the protruding part of each epilating leaf are formed to chamfer shape which makes the hair of the hair intake groove go more easily into the clamping gap.

On the opposite inside surface of the protruding part of each epilating leaf there are several protruding parts which are located along the circle, each protruding part being set between the two protruding parts of nearby epilating leaf, whereby allowing all the epilating leaves to synchronously rotate.

It is clear that from the above description of the present invention that, comparing with the existing technology, the present invention has the following advantages:

The present invention overcomes the inertia thinking, which is that the epilating leaf set must act through extruding components to extrude the epilating leaves to finish the epilating action, innovatively uses the simple, squat-cylinder shaped epilating leaves and does not need to extrude other components to finish the epilating action. Since the epilating leaves are single, squat-cylinder shaped and all the structures of the epilating leaves are the same and can use plastic material, so one can use the same mould to do injection, and thus greatly saves the cost of tooling and also reduces the cost of production. In addition, since the structure of the epilating leaf set is very simple, this makes the epilating leaf set to have a stable working function, thereby preventing the epilating leaf from easily coming out.

DESCRIPTION OF EXEMPLARY EMBODIMENTS OF THE INVENTION

Figure 1:
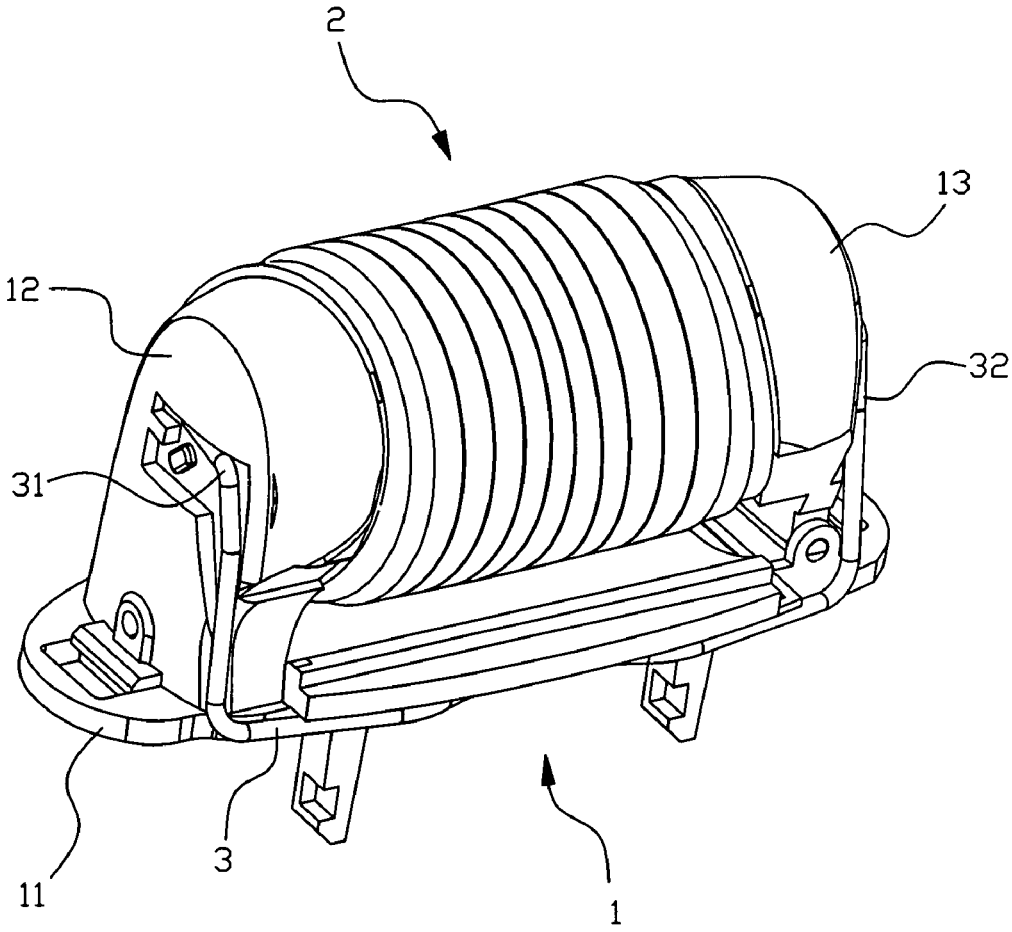
FIG. 1 is a stereogram of the present invention.
Figure 2:
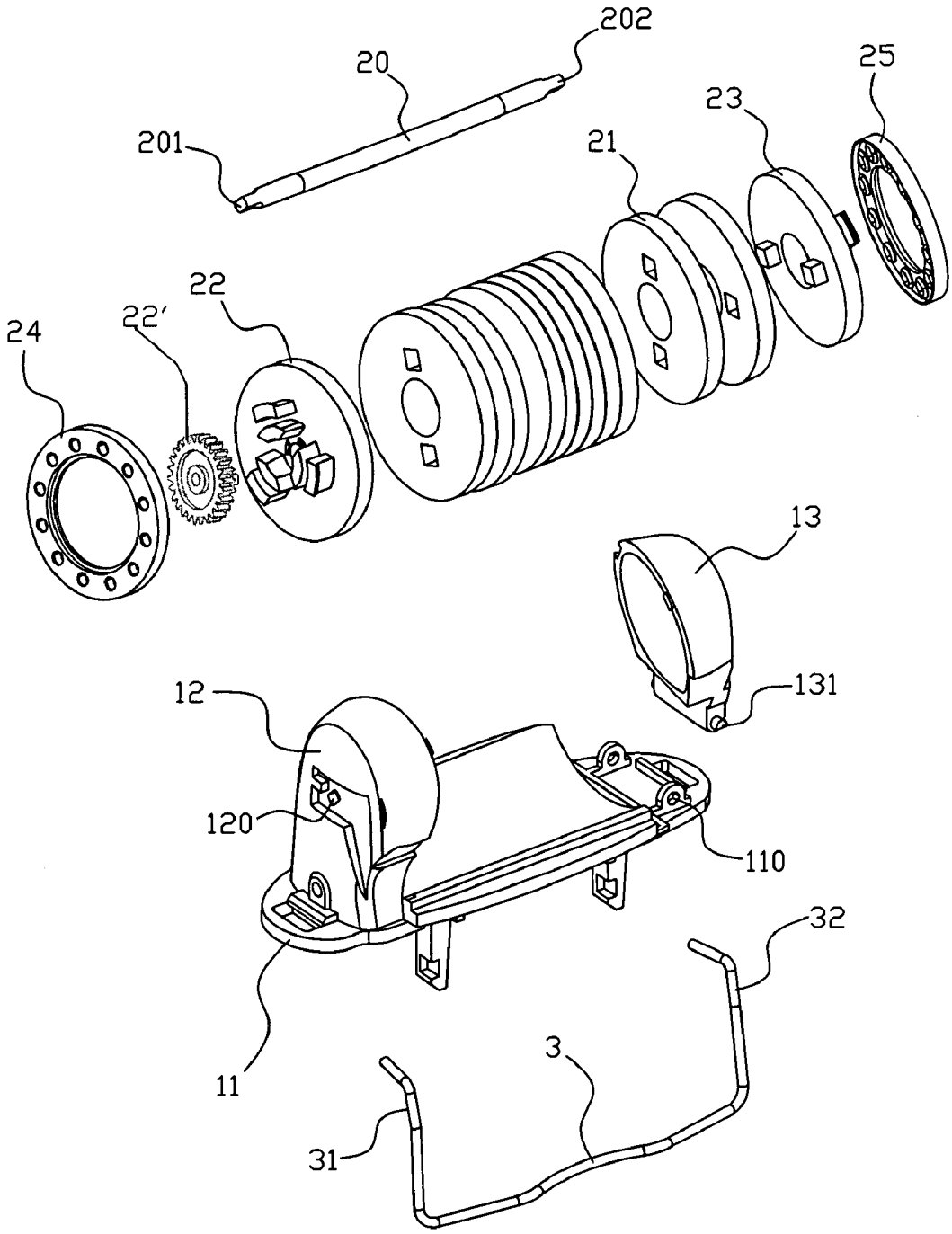
FIG. 2 is an exploded view of the present invention.

The first embodiment of the present invention, referring to FIG. 1 and FIG. 2, is explained as follow: the epilator comprises the epilating leaf set 2 and the motor device which drives the main shaft 20 of the epilating leaf set 2. The motor device, which is of ordinary technology, mainly comprising a motor and a driving gears group, is not shown in the drawings. The epilating leaf set 2 comprises an arc shaft 20, on which there are at least two epilating leaves 21 of synchronous rotation, which can be squat-cylinder shaped. The each epilating leaf 21 can be a single structure and can be made by one time plastic injection. The two epilating leaves 21 form an epilating gap therebetween. When it is working, the main shaft 20 does not rotate, while all the epilating leaves 21 rotate around the main shaft 20, and when the hair on skin surface goes into the epilating gap, the rotating nearby two epilating leaves 21 will clamp and remove the hair and then release.

Figure 3:
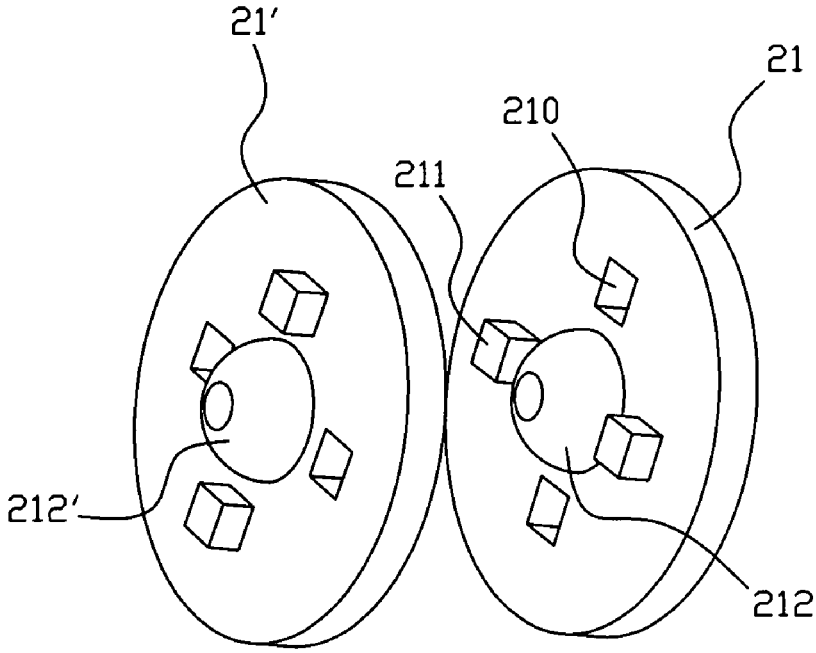
FIG. 3 is a stereogram of the epilating leaf of the first embodiment of the present invention.
Figure 4:
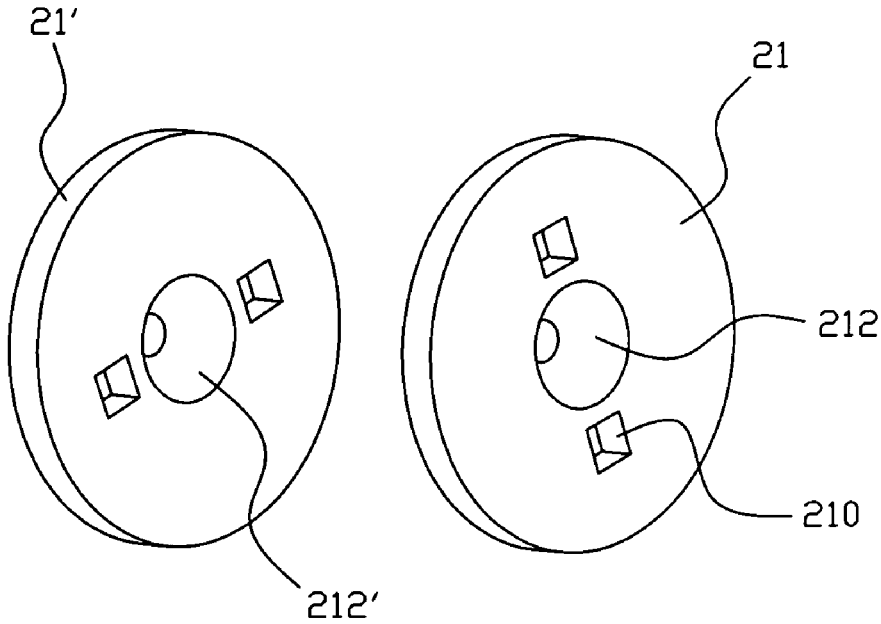
FIG. 4 shows the stereogram of the epilating leaf showed in FIG. 3 from another angle.

Referring to FIG. 3 and FIG. 4, the central position of the epilating leaf 21 forms a connecting part 212, one side of the connecting part 212 being a protruding spherical surface, the other side being a concave spherical surface. The main shaft 20 passes through all the central positions of the connecting parts 212, and the protruding side of the connecting part 212 of the epilating leaf 21 is movable engaged with the concave side of the connecting part 212' of the nearby epilating leaf 21'. When each epilating leaf 21 is rotating, the engaging of the connecting part 212 with each other will make all the epilating leaves 21 smoothly rotate, and the connecting part 212 functions as a spherical bearing.

In some embodiments, on one side of the said each epilating leaf 21, there are a protruding part 211 and a concave part 210, which can be engaged with the corresponding concave part and the corresponding protruding part of a nearby epilating leaf so to as to make all the epilating leaves 21 synchronously rotate.

In some embodiments, the epilating leaf set 2 can be assembled on a base 1, the base 1 comprising a bottom base 11, a fixture 12 which is set on the one side of the bottom base 11, a moveable fixture 13 which is set on the other side of the bottom base 11, and a U shaped spring 3. The moveable fixture 13 is engaged with the connecting hole 110 which is located on one side of the bottom base 11 through the connecting shaft 131 which is located on the bottom. The two ends 201, 202 of the main shaft 20 are assembled on the fixture 12 and the moveable fixture 13. The main shaft 20 is connected with the fixture 12 and the moveable fixture 13 through the two squat-cylinder shaped ends 201, 202 so as to form an non-rotatable connection, which means that the main shaft 20 can not rotate around the base 1. All the epilating leaves 21 are clamped together between the fixture 12 and the moveable fixture 13. The two ends 31, 32 of the U shaped spring 3 clamp closely all the epilating leaves 21 from outsides of the fixture 12 and the moveable fixture 13 so as to impart a certain clamping force between the each epilating leaf 21 of the epilating leaf set 2.

Referring to FIG. 2, all the epilating leaves 21 together form a epilating leaf set, on the two sides of the epilating leaf set there being driving connecting leaves 22, 23, respectively. The driving connecting leaves 22, 23 are engaged with the connecting part of a nearby epilating leaf by the protruding part and concave part to allow a synchronous rotation, wherein the driving connecting leaf 20 is connected with the gear 22', and the gear 22' is to connect with the last gear of the motor device gear group. Here the firm connection functions as a kind of inserting connection such that the driving connecting leaf 22 can not relatively rotate with the said last gear. so as to allow the motor device to drive the entire epilating leaf set to rotate through the driving connecting leaf 22. Further, between the connecting leaf and the fixture 12, and between the connecting leaf and the moveable fixture 13, there are thrusting bearings 25, 24 respectively.

Figure 5:
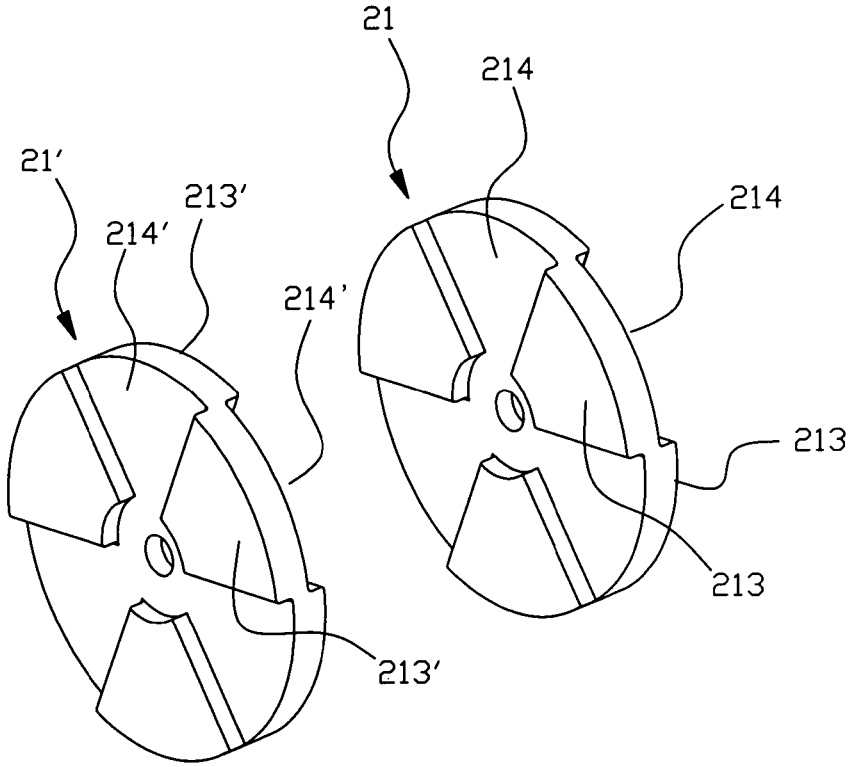
FIG. 5 is a stereogram of the epilating leaf of the second embodiment of the present invention.

The second embodiment of the present invention refers to FIG. 5, the main structure and principle are same as the above the first embodiment, and the difference is the connecting structure of synchronous rotation of the epilating leaf 21. In the present embodiment, on the side of the epilating leaf 21, there are fan-shaped protruding parts 213, and two fan-shaped protruding parts 213 form a fan-shaped concave part 214 therebetween. The fan-shaped protruding part 213 and fan-shaped concave part 214 of the epilating leaf 21 are respectively engaged with the corresponding fan-shaped concave part 214' and the corresponding fan-shaped protruding part 213' of a nearby epilating leaf 21' so as to allow a synchronous rotation.

Figure 6:
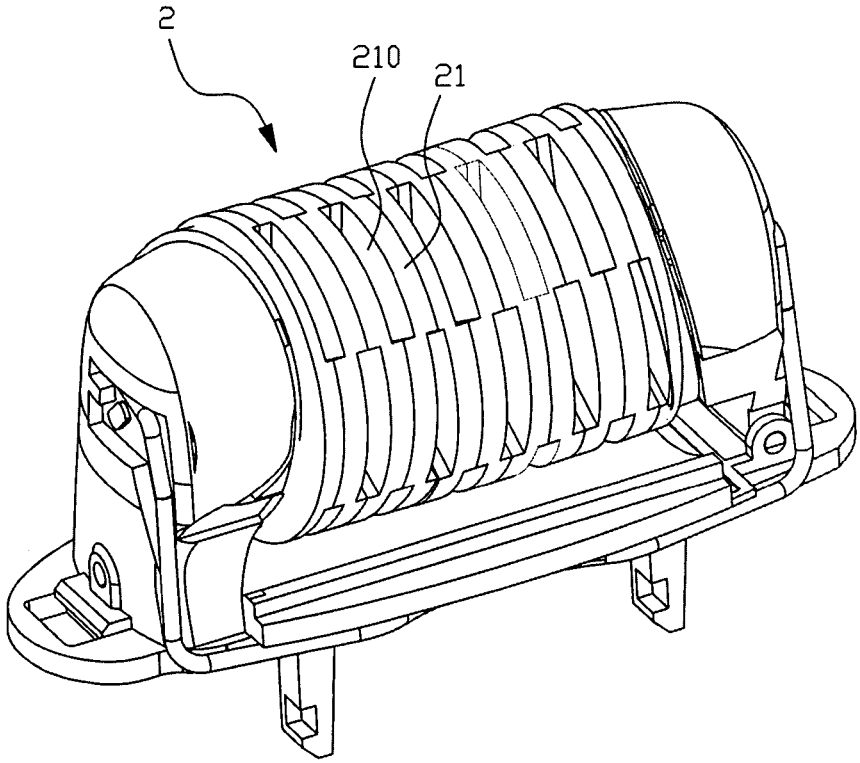
FIG. 6 is a stereogram of the third embodiment of the present invention
Figure 7:
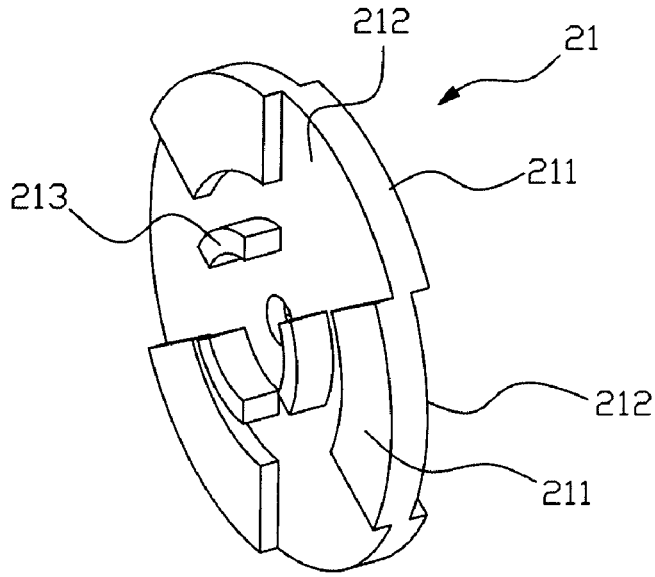
FIG. 7 is a stereogram of the epilating leaf of the third embodiment of the present invention

The main structure and principle of the third embodiment of the present invention are similar to the above first embodiment, its main differences are: referring to FIG. 6 and FIG. 7, on the opposite surface of each epilating leaf 21 of the epilating leaves set 2, there are a concave part 212 and protruding part 211 which are interleavingly located along the circle of the epilating leaf 21. Between the two concave parts 212 which are set on the opposite surface of the two nearby epilating leaves 21 forms hair intake groove 210. Between the two protruding parts 211 which are set on the opposite surface of the two nearby epilating leaves 21 forms hair clamping gap, the function of the hair intake groove 210 is to make the hair on skin to to go more easily into the hair clamping gap, the hair intake groove 210 and the hair clamping gap together form the said hair clamping gap of the first embodiment.

Referring to FIG. 7, on the opposite inside surface of the protruding part 211 of each epilating leaf 21 there are several protruding parts 213 which are located along the circle, each protruding part 213 is set between the two protruding parts 213 of nearby epilating leaf 21, so as to allow a synchronous rotation of each epilating leaf 21.

The main feature of this embodiment compared with the first embodiment is that it has a structure of the hair intake groove 210, causing the hair on the skin to go more easily into the hair clamping gap of the two nearby epilating leaves 21.

Figure 8:
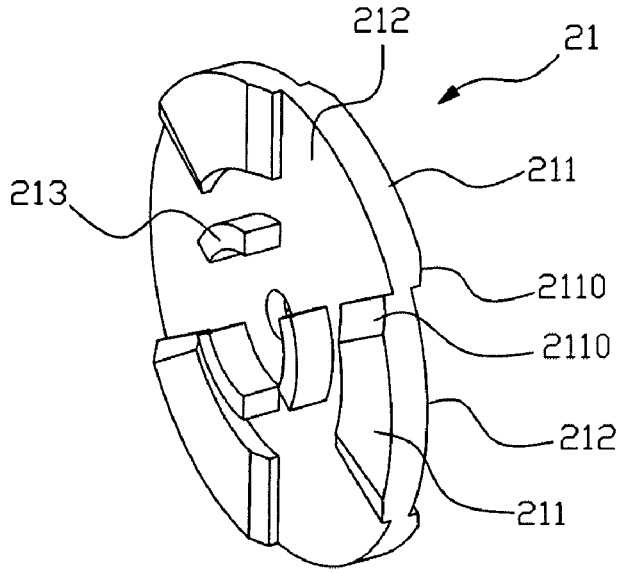
FIG. 8 is a stereogram of the epilating leaf of the fourth embodiment of the present invention

The main structure and principle of the fourth embodiment of the present invention are the same as the third embodiment, referring to FIG. 8, the main difference is that the two ends of the protruding part 211 of each epilating leaf 21 are formed to chamfer 2110 which makes the hair of the hair intake groove 210 to go more easily into the hair clamping gap. The chamfer 2110 also can be formed as a round, so as to cause the hair of the hair intake groove 210 to be easier to go into the hair clamping gap.

The embodiments described above do not limit the scope of the present invention. Equivalent changes and modifications based on the contents of the present invention fall within the scope of the present invention.

I claim:

1. An epilator with an improved structure comprising:

a plurality of synchronously rotating squat-cylinder shaped epilating leaves;

a main arc shaft extending through the epilating leaves;

a motor device driving the epilating leaves;

a base comprising a spring, a bottom base, a first fixture on the bottom base, and a second fixture on the bottom base and configured to move relative to the first fixture, wherein a first end segment of the main arc shaft is set on the first fixture and a second end segment of the main arc shaft is set on the second fixture, wherein the epilating leaves are disposed between the first and second fixtures, wherein the spring engages the second fixture in a manner that causes the epilating leaves to be clamped together between first and second fixtures, wherein each one of the epilating leaves is a single structure and every two of the epilating leaves form an epilating gap therebetween, wherein each epilating leaf comprises a connecting part at a center position on the epilating leaf, one side of the connecting part comprising a protruding semi-spherical surface, an other side comprising a concave semi-spherical surface, wherein the main shaft passes through the protruding semi-spherical surface and the concave semi-spherical surface of the connecting part on the each epilating leaf, and wherein the protruding semi-spherical surface on the each epilating leaf is movably engaged with the concave semi-spherical surface of an adjacent one of the epilating leaves.

2. The epilator 1, wherein each side of the each epilating leaf has a protrusion and a hole, both of which are respectively engaged with the hole and the protrusion of an adjacent one of the epilating leaves, wherein the engagement enables all the epilating leaves to synchronously rotate.

3. The epilator of claim 1, wherein the first and second ends of the main arc shaft are supported by the first and second fixtures, respectively, wherein all the epilating leaves together form an epilating leaf set; the epilator further comprising a driving connecting leaf disposed at opposite ends of the epilating leaf set, one of the driving connective leaves connected to a gear of the motor device, each one of the driving connecting leaves engaged with the connecting part of an adjacent one of the epilating leaves.

4. The epilator of claim 3, further comprising a first thrust bearing disposed between the first fixture and the driving connecting leaf that is nearest the first fixture, and a second thrust bearing disposed between the second fixture and the driving connecting leaf that is nearest the second fixture.

5. The epilator of claim 1, wherein—each side of each epilating leaf comprises recessed portions and protruding portions, the recessed and protruding portions arranged in an interleaving and circular pattern around the epilating leaf so that the recessed and protruding portions alternate with each other, wherein—the recessed portions of adjoining epilating leaves face toward each other and are at angular positions that are aligned so as to form hair intake grooves having sides formed by the aligned recessed portions, and wherein—the protruding portions of adjoining epilating leaves face toward each other and are at angular positions that are aligned so as to form the epilating gaps having sides formed by the aligned protruding portions, and wherein the epilating leaves are configured to clamp onto hair in the epilating gaps.

6. The epilator of claim 5, wherein, on each epilating leaf, each of the protruding portions of the epilating leaf includes a chamfer disposed next to an adjacent one of the recessed portions of the epilating leaf, the chamfers configured to guide hair from the hair intake grooves to the epilating gaps.

7. The epilator of claim 5, wherein each side of each epilating leaf includes a plurality of protruding parts arranged along a circle around the center of the epilating leaf, each one of the protruding parts on the epilating leaf disposed between two protruding parts of an adjacent epilating leaf in a manner that enables all the epilating leaves to synchronously rotate.

8. The epilator of claim 1, wherein each one of the epilating leaves is configured to clamp onto hair in the epilating gap.

9. The epilator of claim 1, wherein the first and second ends of the main arc shaft are attached to the first and second fixtures, respectively, in a manner that prevents the main arc shaft from rotating relative to the base.

10. The epilator of claim 1, wherein the second fixture tilts about a pivot on the base.

11. The epilator of claim 1, wherein the spring tilts the movable fixture relative to the bottom base.

12. The epilator of claim 1, wherein each of the epilating leaves has an outer circumference in the shape of a circle.

13. An epilator comprising:

a main shaft; and a plurality of epilating disks carried on the main shaft;

wherein each of the epilating disks comprises a center portion, an obverse side of the center portion having a protruding semi-spherical surface, a reverse side of the center portion having a concave semi-spherical surface, the main shaft passes through the protruding semi-spherical surface and the concave semi-spherical surface on each epilating disk, the protruding semi-spherical surface on each epilating disk is disposed inside a depression formed by the concave semi-spherical surface of an adjacent one of the epilating disks.

14. The epilator of claim 13, further comprising:

a bottom base;

a first fixture at a first end segment of the main shaft, the first fixture attached to the bottom base;

a second fixture at a second end segment of the main shaft, the second fixture attached to the bottom base in a manner that enables the second fixture to move towards the first fixture; and a spring having a first end segment engaged with the first fixture and a second end segment engaged with the second fixture.

15. The epilator of claim 13, wherein each side of each epilating disk includes a protrusion and a hole, the protrusion and the hole being spaced apart from the center portion of the epilating disk, the hole of each epilating disk configured to receive the protrusion of an adjacent one of the epilating disks to allow all the epilating disks to synchronously rotate.

* * * * *